US010807222B2

(12) United States Patent
Wallman et al.

(10) Patent No.: US 10,807,222 B2
(45) Date of Patent: Oct. 20, 2020

(54) BALL-AND-SOCKET JOINT PULLER

(71) Applicant: Wallmek i Kungälv AB, Kungälv (SE)

(72) Inventors: Niklas Wallman, Kungälv (SE); Martin Hasselskog, Kärna (SE); Sten Johansson, Lycke (SE)

(73) Assignee: WALLMEK I KUNGÄLV AB, Kungälv (SE)

( * ) Notice: Subject to any disclaimer, the term of this patent is extended or adjusted under 35 U.S.C. 154(b) by 176 days.

(21) Appl. No.: 16/021,868

(22) Filed: Jun. 28, 2018

(65) Prior Publication Data

US 2019/0009397 A1 Jan. 10, 2019

(30) Foreign Application Priority Data

Jul. 4, 2017 (EP) ..... 17179578

(51) Int. Cl.
*B25B 27/02* (2006.01)
*B25B 27/00* (2006.01)
*B25B 27/06* (2006.01)

(52) U.S. Cl.
CPC ..... *B25B 27/026* (2013.01); *B25B 27/0035* (2013.01); *B25B 27/064* (2013.01)

(58) Field of Classification Search
CPC ... B25B 27/064; B25B 27/00; B25B 27/0035; B25B 27/062; B25B 27/023; B23P 11/027; B23P 19/00; B23P 19/02; B23P 19/10

(Continued)

(56) References Cited

U.S. PATENT DOCUMENTS 2,076,462 A * 4/1937 Horechney ..... B25F 1/003 81/168
2,169,898 A * 8/1939 Minderman ..... B25B 27/023 29/267

(Continued)

FOREIGN PATENT DOCUMENTS

DE 20 2006 015070 U1 12/2006
DE 20 2007 011248 U1 10/2007

(Continued)

OTHER PUBLICATIONS

Extended Search Report dated Feb. 1, 2018, in the corresponding European Patent Application No. 17179578.4-1019 (6 pages).

*Primary Examiner* — Tyrone V Hall, Jr.
(74) *Attorney, Agent, or Firm* — Buchanan Ingersoll & Rooney P.C.

(57) ABSTRACT

A dismounting tool for disengaging ball joint connections on suspension and steering assemblies is disclosed. The dismounting tool comprises an actuator having two receiving portions, where the actuator is operable to force two receiving portions towards each other along an actuation axis. The dismounting tool further comprises a first tool member having an anvil portion with an engaging surface and a second tool member having a bifurcated portion with a supporting surface. Each of the tool members comprises a through hole and are detachably mounted to a respective receiving portion such that the through holes are arranged coaxially about the actuation axis such that the engaging surface faces the supporting surface. The actuator is, upon actuation, configured to move the two tool members towards each other along the actuation axis.

15 Claims, 10 Drawing Sheets

(58) Field of Classification Search
USPC ..... 29/232, 252, 255, 256, 259, 261
See application file for complete search history.

(56) References Cited

U.S. PATENT DOCUMENTS

| | | | | |
|---|---|---|---|---|
| 6,574,846 | B1 * | 6/2003 | Kang | B25B 27/0021 29/239 |
| 7,487,942 | B2 * | 2/2009 | Krohmer | B25B 1/103 248/230.3 |
| 2012/0204393 | A1 * | 8/2012 | Gentner | B25B 27/0035 29/257 |

FOREIGN PATENT DOCUMENTS

| | | | | |
|---|---|---|---|---|
| DE | 10 2012 107943 | A1 | 3/2014 | |
| EP | 2 025 474 | A2 | 2/2009 | |
| EP | 2025474 | A2 * | 2/2009 | B25B 27/06 |

* cited by examiner

BALL-AND-SOCKET JOINT PULLER

CROSS REFERENCE TO RELATED APPLICATIONS

The present application claims the benefit of European Application No. 17179578.4, filed on Jul. 4, 2017. The entire contents of European Application No. 17179578.4 are hereby incorporated herein by reference in their entirety.

TECHNICAL FIELD OF THE INVENTION

The present invention relates to tools for vehicles (such as cars, buses, trucks, etc.), and more specifically it relates to a tool for dismounting steering joints and ball joints on vehicles.

BACKGROUND

There is an ever present need to reduce costs and to facilitate the life of workshop (vehicle repair shop) operators, i.e. mechanics. The immense number of manufacturers in the automotive industry often leads to an even larger number of tools and equipment within the workshops. Many times this problem originates due to the fact that a specific vehicle component will have different dimensions, number of bolts or other structural details depending on which manufacturer it originates from.

Consequently, workshops are oftentimes forced to have a large number of tools which essentially serve the same purpose which can be both costly and inconvenient. Examples of vehicle components that differ in dimensions and other structural details, as mentioned in the foregoing are, e.g. steering joints or ball joints in axle and steering systems of vehicles.

Various pullers or dismounting tools for steering- and ball joints are known from the prior art, as for example described in EP 2 025 474, but such, and other known devices are prone to some general drawbacks. For example, they are generally perceived as heavy, difficult to operate, and many times different tools are required for each specific dimension or joint configuration which increases the workload for the operator/mechanic.

In more detail, steering- and ball joints are vehicle components which are manufactured in a large number of different dimensions, and moreover, steering- and ball joints must often be dismounted or disassembled even during regular maintenance of the vehicle. More specifically, the dimensional variety translates in that the conical engagement between the joints are of different length for different models, and also the diameter may differ between different models. Therefore, workshops are oftentimes required to house a great number of tools, essentially for the same purpose, which is not only costly but also cumbersome to manage.

Moreover, another problem with current solutions is that there is a non-negligible risk of the puller inadvertently coming off the ball joint during operation which can damage the vehicle, and in some cases, even pose a risk for the operator/mechanic. Also, in many modern vehicles, space is a limited resource, and the areas surrounding the steering- and ball joints are no exception, which results in that the space for the puller/dismounting tool is rather limited resulting in a need for space efficient and versatile solutions.

To this end, "universal" pullers have been proposed, as for example described in DE 10 2012 107 943, but there is still a need for improvements in the art. More specifically, there is a need for a steering- and ball joint puller/dismounting tool which is reliable, easy to handle, but furthermore capable of dismounting the steering and ball joints without causing irreparable damages on the same (e.g. damaging the rubber boots or the threaded portions).

SUMMARY OF THE INVENTION

It is therefore an object of the present invention to provide a dismounting tool for disengaging ball joint connections on suspension and steering assemblies, which alleviates all or at least some of the above-discussed drawbacks of presently known solutions.

This object is achieved by means of a dismounting tool as defined in the appended claims.

According to a first aspect of the present invention there is provided a dismounting tool for disengaging ball joint connections on suspension and steering assemblies.

an actuator comprising a first receiving portion and a second receiving portion, the actuator being operable to force the first and second receiving portions towards each other along an actuation axis;

a first tool member comprising an anvil portion with an engaging surface;

a second tool member comprising a bifurcated portion with a supporting surface;

wherein each of the first tool member and the second tool member comprises a through hole, and wherein the first tool member and the second tool member are detachably mounted to the first receiving portion and the second receiving portion such that the through holes are arranged coaxially about the actuation axis, and such that the engaging surface faces the supporting surface; and wherein, upon actuation, the actuator is configured to move the first and second tool members towards each other along the actuation axis.

Hereby presenting a robust, compact and user-friendly dismounting tool for disengaging ball joint connections on suspension and steering assemblies.

Many of the difficulties related to dismounting or disengaging ball joint connections are related to a lack of space around the general working area which contributes to a non-negligible risk of causing damage to the vehicle due to improper positioning of the dismounting tool or tool members and the large forces required for disengaging the ball joint connections. Thus, by providing a versatile dismounting tool which is adaptable to various situations and where the engaging parts (herein referred to as tool members), that are brought in contact with the ball joint connection, are securely attached and capable of providing a continuous pressing force to the joint connection, a relatively simple and reliable dismounting operation is achievable.

The present invention is based on the realization that by attaching the tool members directly on to the actuator such that the tool members and the actuator share a common actuation axis, the whole dismounting tool can be made very compact and reliable. Moreover, since the tool members are detachably mounted to the actuator it provides a possibility for reconfiguration and adaptation of the tool to specific situations in terms of accessibility and dimensional variations, thereby making the tool more universal as compared to presently known solutions. For example, it is possible to have a set of tool members of different dimensions suitable for use during maintenance of various types of vehicles such as cars, buses, trucks, etc.

It is to be understood that when a surface faces another surface, the two surfaces each have a normal vector perpendicular to the surface plane that is pointing in the general direction towards the other surface. In more detail, the engaging and supporting surfaces generally extend in directions that are substantially perpendicular to the actuation axis. Substantially perpendicular means that the surface planes have a normal vector that deviates 0°±20° from the actuation axis of the actuator, when the tool members are mounted to the actuator. Stated differently, the engaging and supporting surfaces each define a plane that has a general extension 90°±20° from the actuation axis when the tool members are mounted to the actuator.

An actuator is in the present context to be understood as a device capable of converting energy provided by an energy source (e.g. electric current, hydraulic fluid pressure or pneumatic pressure) into mechanical motion. The output mechanical motion is preferably a linear motion along an axis referred to as the actuation axis.

Further, in accordance with an embodiment of the present invention, each of the first receiving portion and the second receiving portion is provided with a shoulder section for preventing the first and second tool members from moving away from each other when the first and second tool members are attached to the actuator. Hereby, instead of mounting the tool members to the actuator by screwing them onto the receiving portions in order to secure the tool members in both axial directions (along the actuation axis), the tool members may simply be snapped on and kept in place by relatively low forces (e.g. a spring force) while the shoulder sections provide the required support for the tool members in opposite axial directions (i.e. away from each other) during use. Since the tool members, in use, are arranged on either side of the ball joint connection, they will be at least partly sandwiched between the shoulder sections and the ball joint connection and thereby kept securely in place. However, when the dismounting tool is not in active use, e.g. when it is carried or pre-positioned and therefore not actuated, the tool members only need to be able to more or less carry their own weight, wherefore there is no need for a supporting should section or a rigid attachment in the other axial direction (inwardly towards each other). Accordingly, the whole dismounting tool is relatively quick and simple to assemble, making it user friendly. Thus, in accordance with another embodiment of the present invention, each of the first and second tool members further comprises a (detachable) fastening element for securing the first and second tool members to the first receiving portion and the second receiving portion. The fastening element may for example be a spring loaded fastening element or a clamping ring allowing the tool members to be detachably mounted to the actuator. This allows for easy "snap-on" engagement of the tool members, making the tool easy to use. More specifically, the fastening means may for example be a spring loaded ball plunger (which may or may not be threaded) which engages a corresponding groove or recess in the receiving portions of the actuator.

Still further, in accordance with yet another embodiment of the present invention, the first tool member and the second tool member are interchangeably and detachably mounted to the first receiving portion and the second receiving portion. In other words, the two tool members can be detachably mounted on either one of the two receiving portions. This is useful in order to be able to rotate the whole tool (including the actuator) to fit in specific situations where there may be more space provided on one side of the ball joint connection. More specifically, the two tool members are differently structured (anvil portion vs bifurcated portion) since they have different functions, where one will act as a counter hold and the other will press against the ball joint in order to disengage it from its housing.

For example, if the actuator would be constructed such that the first receiving portion is provided at an end portion of the actuator while the second receiving portion is provided at a central or intermediate portion of the actuator, resulting in that a part of the actuator will protrude away from the second receiving portion (e.g. the protruding part may be the housing a hydraulic or pneumatic cylinder having an inlet for hydraulic fluid or pressurized air, respectively). Accordingly, by having the tool members interchangeably attachable to either one of the receiving portions, the tool may be adapted to many various situations and applications pending on availability of space on around the ball joint connection during use of the dismounting tool, such that the protruding part of the actuator can be accommodated on the spacious side of the ball joint connection.

Further, in accordance with yet another embodiment of the present invention, the anvil portion is a first anvil portion and said engaging surface is a first engaging surface, and wherein said first tool member comprises a second anvil portion having a second engaging surface, the second anvil portion being arranged on an opposite side of the through hole of the first tool member relative to the first anvil portion. By having two anvil portions in the first tool member, the dismounting tool can be re-arranged for different applications by relatively simple means, such as e.g. by twisting the tool member 180°. The two anvil portions can for example have different dimensions, surface angles or other structural differences, making the dismounting tool more universal. Accordingly, the first tool member may be rotatable about the actuation axis such that it is attachable to either one of the first receiving portion and the second receiving portion in two operating positions. In more detail, the first tool member is preferably attachable to one of the receiving portions in a first operating position where said first engaging surface faces said supporting surface and a second operating position where said second engaging surface faces said supporting surface. However, the first tool member may also have more than two anvil portions symmetrically arranged around the through hole, and a corresponding amount of operating positions. As previously mentioned, the two anvil portions may have structural differences, thus, in accordance with yet another embodiment of the present invention, the first engaging surface and the second engaging surface are provided at different heights relative to each other along the central axis. Thereby, the distance between the first engaging surface and the supporting surface in the first operating position is different from the distance between the second engaging surface and the supporting surface in the second operating position. Thus, by a simple twist of the first tool member, the dismounting tool is compatible with two separate dimensional ranges of ball joint connections. In more detail, the actuator may have a stroke length in the range of 15 mm to 40 mm, such as e.g. 20 mm or 25 mm. For example, the actuator's stroke length may be 30 mm, resulting in the dismounting tool having an operating range, in the first operating position, between 30 mm to 60 mm. The operating range being the minimum and maximum achievable distance between the first engaging surface and the supporting surface of the second tool member. However, by arranging the first tool member in the second operating position, where the distance to between the second engaging surface and the supporting surface of the second tool member may be greater, e.g. 10 mm greater than in the previous case. Then the operating range of the dismounting tool is adjusted to be between 40 mm and 70 mm. Naturally, the skilled person realizes that the dimensions, stroke lengths, etc. are only examples of specific embodiments, and that they may be different in other embodiments of the invention. For example, for bus and truck applications the stroke lengths of the actuator and the dimensions of the tool members may be larger.

Furthermore, in accordance with yet another embodiment of the present invention the bifurcated portion is a first bifurcated portion and the supporting surface is a first supporting surface, and wherein the second tool member further comprises a second bifurcated portion having a second supporting surface, the second bifurcated portion being of a different dimension than the first bifurcated portion and arranged on an opposite side of the through hole of the second tool member relative to the first bifurcated portion. As previously discussed in reference to the first tool member, by analogously having two bifurcated portions the dismounting tool can be made more adaptable to different situations and therefore more universal. The term "different dimensions" is to be interpreted broadly and can cover any type of structural difference between the two bifurcated portions, such as e.g. larger separation between the protruding parts, differently shaped recess, generally wider, longer, etc. Accordingly, in yet another embodiment of the invention, the second tool member is rotatable about the actuation axis such that it is attachable to either one of the first receiving portion and the second receiving portion in two operating positions. Thus, in combination with the embodiment where the first tool member has two anvil portions, the dismounting tool is provided with four different configurations for being compatible with ball joint connections of various dimensions and configurations. However, the second tool member may also have more than two bifurcated portions symmetrically arranged around the through hole, and a corresponding amount of operating positions.

Yet further, in accordance with yet another embodiment of the present invention, each of the first and second tool members comprises an anvil portion and a bifurcated portion, and wherein each of the first and second tool members is rotatable about said actuation axis such that it is attachable to a respective one of said first receiving portion and said second receiving portion in two operating positions. This provides an alternative to the embodiment where the two tool members are interchangeably mounted since the two tool members can instead merely be rotated whereby the bifurcated portion and the anvil portion effectively switch place in reference to the actuator. This provides for a simpler and faster transition and re-configuration, but with the trade-off that there are less possible configurations possible (2 vs 4).

Further, in accordance with yet another embodiment of the present invention, each engaging surface and each supporting surface is slanted inwardly towards each other when the first and second tool members are attached to the actuator. By providing inwardly slanting engaging and supporting surfaces it is possible to reduce the risk of the dismounting tool sliding out of a working position when pressure is applied to the ball joint connection.

The actuator may in accordance with an embodiment of the invention be a hydraulic cylinder and the actuation axis a central axis of the hydraulic cylinder. Using a hydraulic cylinder as the actuator provides the advantage that the whole dismounting tool can be made relatively compact and it is possible to apply a steady and even pressing force to the ball joint connection, thereby reducing the risk of damaging any vehicle components. The hydraulic cylinder may for example comprise a piston part comprising said first receiving portion, and a cylinder housing comprising said second receiving portion and an inlet for receiving hydraulic fluid. The hydraulic cylinder is preferably a single-acting hydraulic cylinder such that, upon actuation, the piston part (including a piston rod) is pulled in into the cylinder housing whereby the first and second receiving portions are forced towards each other along the actuation axis.

Further, in accordance with an embodiment of the present invention, the piston part extends distally from said cylinder housing, and wherein said first receiving portion is provided at a distal end portion of said piston part. The term distal is in the present context to be understood as in a direction away from the cylinder housing towards the protruding part of the piston rod, while the term proximal is accordingly in an opposite direction along the actuation axis. Thus, the second receiving portion is preferably placed at a distal half (closer to the protruding portion of the piston part/rod) of the cylinder housing, wherefore the cylinder housing has a portion which protrudes in a proximal direction relative to the first and second tool members. This protruding portion is preferably provided with the inlet for receiving hydraulic fluid. Accordingly, if the dismounting tool is arranged such that the first and second tool members can be interchangeably mounted to the first and second receiving portions, the dismounting tool is operable in two positions (180° apart) relative to the ball joint connection whereby protruding portion of the cylinder housing can be accommodated on that side of the ball joint connection with the most space.

Further, in accordance with yet another embodiment of the present invention, the piston part further comprises a removable cylindrical adapter defining said first receiving portion;

wherein an outer diameter of said cylindrical adapter part is substantially the same as the diameter of the second receiving portion for interchangeably receiving either one of said first and second tool members. The piston part may for example comprise a threaded portion onto which the removable cylindrical adapter can be mounted by means of a corresponding threaded portion provided on an inner surface of the cylindrical adapter part. Thus, the dismounting tool may accordingly be assembled by removing the cylindrical adapter part from the piston part, arranging one of the tool members on the second receiving portion (on the cylinder housing), arranging the other one of the tool members on the cylindrical adapter part and then mounting the cylindrical adapter part (together with the attached tool member) onto the piston part.

These and other features and advantages of the present invention will in the following be further clarified with reference to the embodiments described hereinafter.

BRIEF DESCRIPTION OF THE DRAWINGS

For exemplifying purposes, the invention will be described in close detail in the following with reference to embodiments thereof illustrated in the attached drawings, wherein.

DETAILED DESCRIPTION

Figure 1:
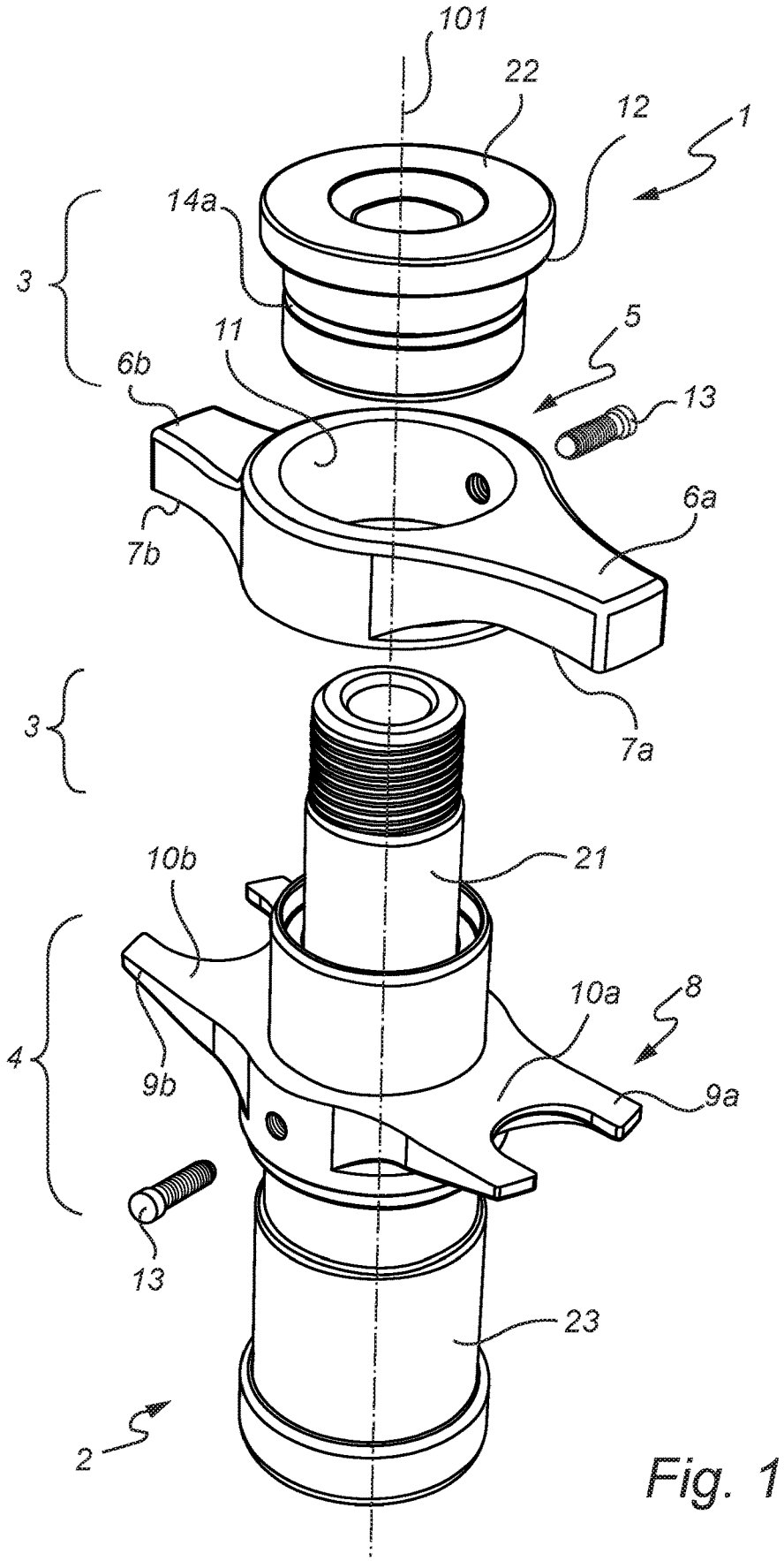
FIG. 1 is a partly exploded perspective view illustration of a dismounting tool in accordance with an embodiment of the present invention.

In the following detailed description, some embodiments of the present invention will be described. However, it is to be understood that features of the different embodiments are exchangeable between the embodiments and may be combined in different ways, unless anything else is specifically indicated. Even though in the following description, numerous specific details are set forth to provide a more thorough understanding of the present invention, it will be apparent to one skilled in the art that the present invention may be practiced without these specific details. In other instances, well known constructions or functions are not described in detail, so as not to obscure the present invention. Like reference characters refer to like elements throughout.

FIG. 1 shows a partly exploded perspective view of a dismounting tool 1 for disengaging ball joint connections on suspension and steering assemblies, in accordance with an embodiment of the invention. The dismounting tool 1 comprises an actuator, here in the form of a hydraulic cylinder 2. The actuator 2 has a first receiving portion 3 and a second receiving portion 4. The first receiving portion is in the illustrated embodiment represented by two separate parts of the actuator 2 due to the partly exploded perspective. In more detail, the first receiving portion 3 is in the form of a piston part 21 (may also be referred to as a piston rod) of the hydraulic cylinder, the piston part comprising a removable cylindrical adapter 22 which can be threaded onto a threaded portion of a piston part 21. The actuator 2 is operable to force the two receiving portions 3, 4 towards each other along an actuation axis 101 of the actuator. The phrase "force the two receiving portions towards each other" does not necessarily mean that both receiving portions must be moved, it is also considered to encompass a scenario in which one of the portions is held in a static position while the other portion is brought closer. In the present embodiment illustrated in FIG. 1, the second receiving portion 4 which is arranged on the cylinder housing 23 of the hydraulic cylinder will be held still while the piston rod 21 is withdrawn into the cylinder housing 23 upon actuation whereby the first receiving portion 3 will be brought closer to the second receiving portion 4.

Accordingly, the dismounting tool 1 is assembled by removing the cylindrical adapter part 22 from the piston part 21, arranging one of the tool members 5, 8 on the second receiving portion 4 (on the cylinder housing), arranging the other one of the tool members 8, 5 on the cylindrical adapter part 22 and then mounting the cylindrical adapter part 22 (together with the attached tool member) onto the piston part 21. In an alternative embodiment (not shown), the piston part 21 may be provided with a threaded hole at a distal end thereof whereby one of the tool members 5, 8 can be arranged on the second receiving portion 4 after which the other one of the tool members 8, 5 is arranged on the first receiving portion 3. Subsequently, a cap or the like may be fixed to the distal end of the piston part 21 by threading it into the threaded hole of the piston part, where the cap can act as a stop or "shoulder section" preventing the tool member attached to the first receiving portion from being pulled off in a distal direction (away from the second receiving portion 5).

The dismounting tool 1 further has a first tool member 5 and second tool member 8. The first tool member has two anvil portions 6*a*, 6*b*, each having an engaging surface 7*a*, 7*b*. The two anvil portions are located on opposite sides of a through hole 11 of the first tool member 5. Analogously, the second tool member 8 has two bifurcated portions 9*a*, 9*b*, each with a corresponding supporting surface 10*a*, 10*b*. The bifurcated portions 9*a*, 9*b* are arranged on opposite sides of the through hole of the second tool member 8. The two tool members 5, 8 are detachably mounted to the first and second receiving portions 3, 4 such that each tool member 5, 8 is arranged coaxially about the actuation axis 101 of the actuator 2. Thus, each receiving portion 3, 4 has a generally cylindrical outer shape which matches the through hole of each tool member 5, 8. The two tool members 5, 8 are furthermore mounted to the receiving portions 3, 4 such that the engaging surfaces 7*a*, 7*b* face towards a corresponding supporting surface 10*a*, 10*b*. Thereby, upon actuation, the actuator 2 is configured to move the first and second tool members 5, 8 towards each other along the actuation axis 101, thereby reducing the distance between the engaging surfaces 7*a*, 7*b* and the supporting surfaces 10*a*, 10*b*. The actuation axis 101 extends through the center of the actuator 2 along its central elongated axis.

Further, each of the receiving portions 3, 4 is provided with a shoulder section for preventing the first and second tool members 5, 8 from moving away from each other when they are mounted to the actuator 2. The first receiving portion 3 has a shoulder section 12*a* provided on a distal end (i.e. in a direction away from the second receiving portion 4) of the cylindrical adapter 22. While the second receiving portion 4 has a shoulder section (e.g. ref. 12*b* in FIG. 3) provided at a proximal end (in a direction away from the first receiving portion 3) of the second receiving portion 4. The terms distal and proximal in reference to the dismounting tool 1 and the actuator 2 are more explicitly indicated by arrows 61 and 62 respectively in FIG. 4.

Figure 4:
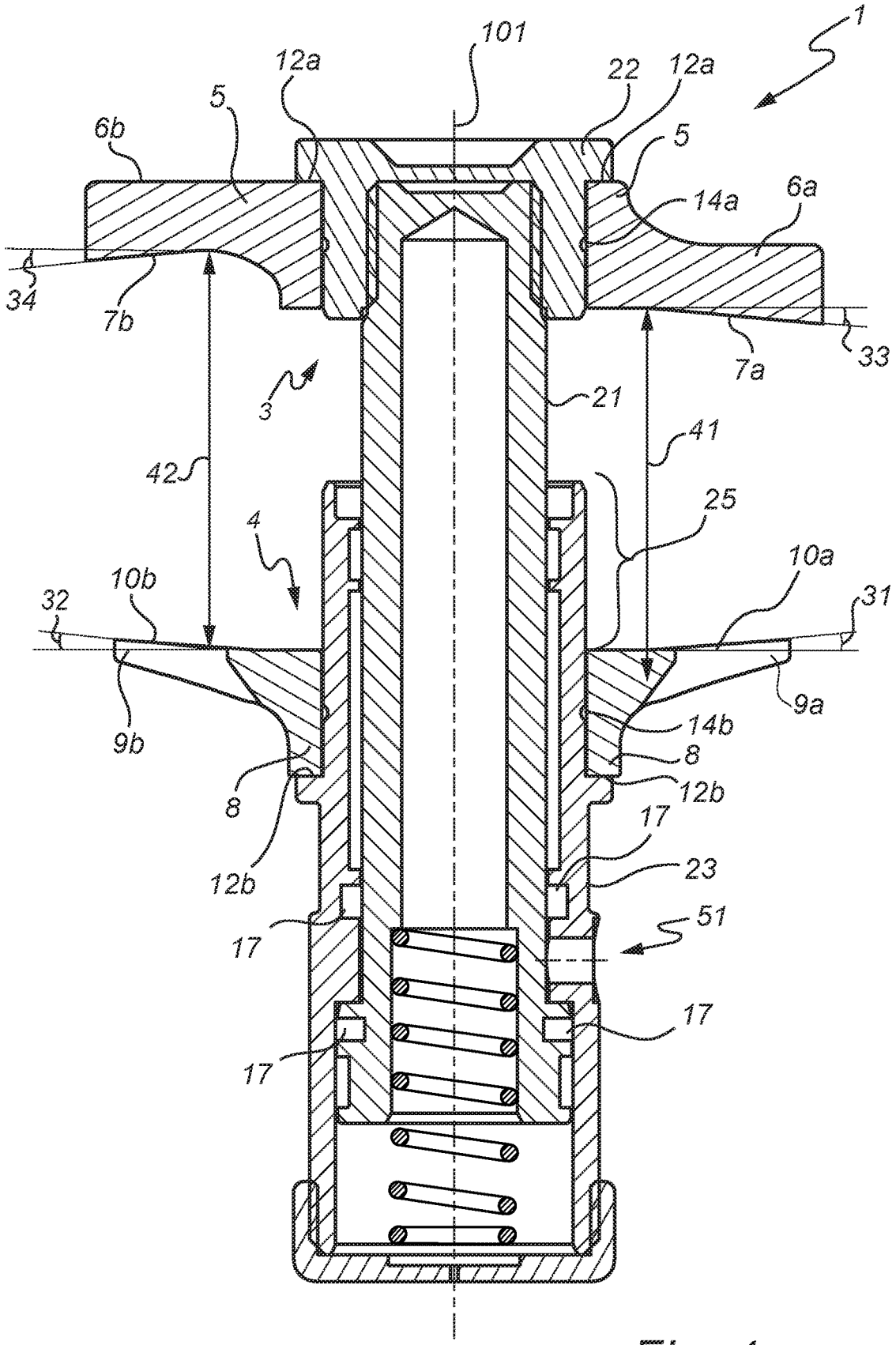
FIG. 4 is a cross-sectional view of the dismounting tool illustrated in FIG. 1.

Still further, each of the first and second tool members 5, 8 comprises a spring loaded fastening element 13, here in the form of spring loaded ball plunger, for securing the tool members 5, 8 to the receiving portions 3, 4. The spring loaded ball engages a matching groove or recess 14*a*, 14*b* in the first and second receiving portions (the groove 14*b* of the second receiving portion is indicated in FIG. 4).

Figure 2:
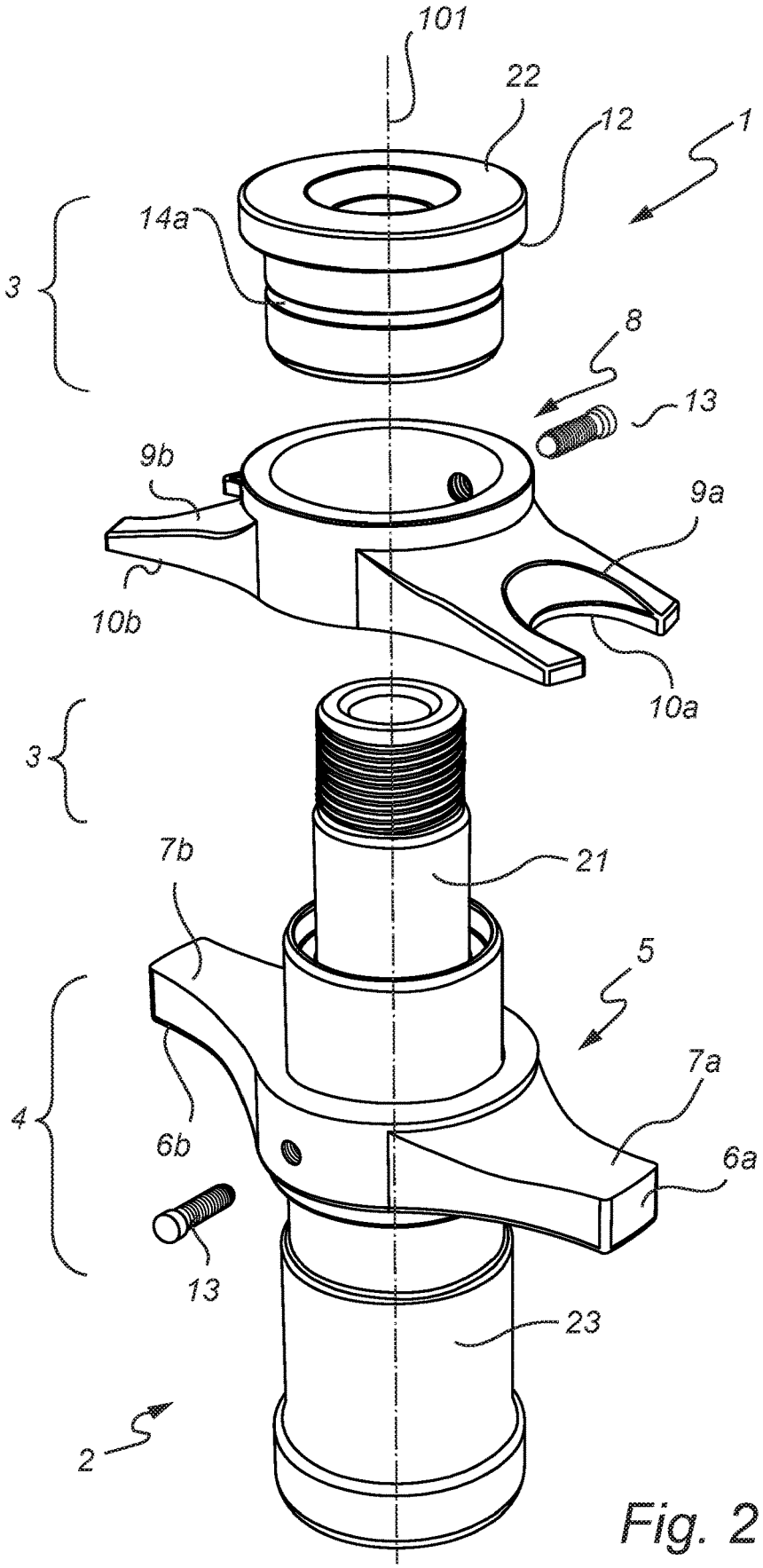
FIG. 2 is a partly exploded perspective view illustration of a dismounting tool in accordance with an embodiment of the present invention.

The first and second tool members 5, 8 are interchangeably attachable to either one of the first and second receiving portions 3, 4. As illustrated in FIG. 2, the tool members 5, 8 have switched places as compared to FIG. 1, and the first tool member 5 is detachably mounted to the second receiving portion 4 while the second tool member 8 is to be detachably mounted to the first receiving portion 3. Moreover, as mentioned, the first tool member 5 and the second tool member 8 are provided with two anvil portions 6*a*, 6*b* and two bifurcated portions 9*a*, 9*b*, respectively, and each tool member 5, 8 is rotatable about the actuation axis 101 such it is attachable to either one of the first and second receiving portions in two operating positions. More specifically, since the first anvil portion 6*a* is structurally different from the second anvil portion 6*b* (engaging surfaces 7*a*, 7*b* at different heights/levels relative to the actuation axis) and the first bifurcated portion 9*a* is structurally different from the second bifurcated portion 9*b* (different dimensions), the dismounting tool 1 can be set in four different configurations/settings by twisting the tool members 5, 8 about the actuation axis 101 and by switching positions of the tool members 5, 8.

In more detail, by having the tool members 5, 8 interchangeably attachable to the actuator 2, the actuator 2 can be used in two opposite orientations relative to a ball joint connection. This is advantageous in situations where space may be limited on one side of the ball joint connection, wherefore the dismounting tool 1 cannot be properly positioned relative to the ball joint connection due to the protruding cylinder housing 23. Thus, by switching the position of the tool members 5, 8 the dismounting tool 1 may be adapted to the situation for the specific vehicle that is to be operated on.

Figure 3:
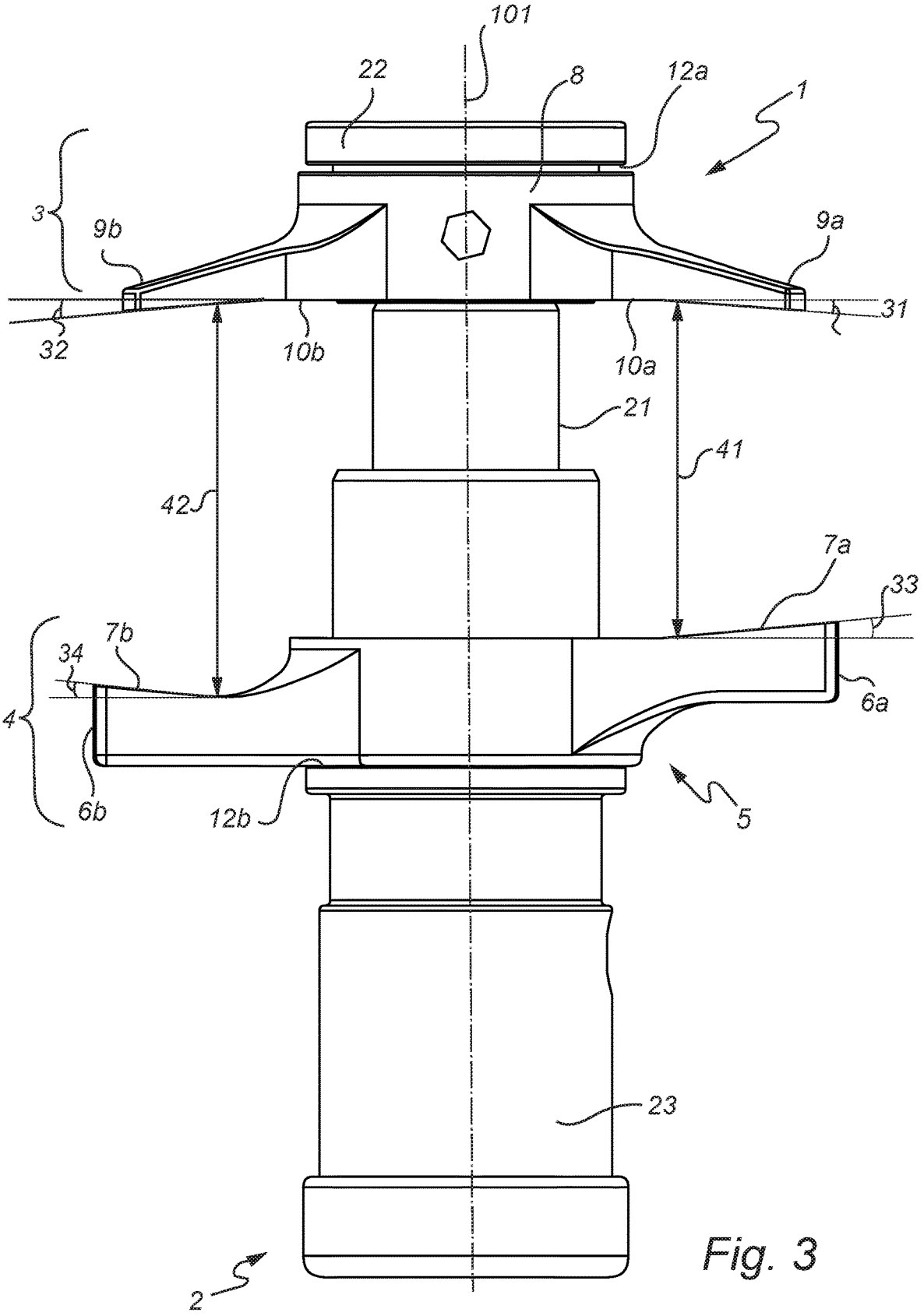
FIG. 3 is a side view of the dismounting tool illustrated in FIG. 2.

The difference between the two anvil portions 6*a*, 6*b* is furthermore elucidated in FIG. 3 which is a side view illustration of the dismounting tool in FIG. 2. The first and second engaging surfaces 7*a*, 7*b* are here arranged at different heights 41, 42 relative to the actuation axis 101. This makes the dismounting tool 1 compatible with a wider range of ball joint connections, thus making the dismounting tool 1 more universal and user friendly (due to easy reconfiguration). Furthermore, each engaging surface 7*a*, 7*b* and each supporting surface 10*a*, 10*b* is slanted inwardly towards each other, as indicated by the angles 31-34. The engaging and supporting surfaces may be slanted inwardly by an angle in the range of 1° to 15°. This surface configuration (the slanting) reduces the risk of the tool sliding out of engagement with the ball joint connection during use due to the high pressing forces being applied in such operations, thereby reducing the risk of damaging vehicle components or injuring operators. In more detail, when the dismounting tool 1 is used and pressure is applied to the ball joint connection, the anvil portion 6 and the bifurcated portion 9 of the first and second tool member 5, 8 respectively, may bend away from each other which increases the risk of the tool sliding away from the ball joint connection. Thus, by making the engaging surfaces 7 and the supporting surfaces 10 slanted inwardly, some of the bending may be counteracted and the contact area between the tool members 5, 8 and the ball joint connection can be maintained at a sufficient level. This is further elucidated in FIG. 10 which shows the dismounting tool 1 in use and how the pressing force causes the tool members to bend away from each other.

FIG. 4 is a cross-sectional view of the dismounting tool 1 illustrated in FIG. 1, where the cross-section is taken along the actuation axis 101 of the actuator 2. As compared to the dismounting tool in FIG. 3, the first and second tool members 5, 8 have switched place again. Moreover, the actuator 2, here in the form of a hydraulic cylinder having a piston part 21 and a cylinder housing 23 with an inlet 51 for receiving hydraulic fluid. The hydraulic cylinder 2 is a single-acting hydraulic cylinder, such that, when it is actuated, i.e. when hydraulic fluid is injected into the inlet 51, the piston part (piston rod) 21 is pulled into the cylinder housing 23, thereby moving the two tool members 5, 8 closer to each other. The hydraulic cylinder 2 has a return spring arranged in the proximal end of the cylinder housing 23 forcing the piston rod 21 in a distal direction towards its expanded "nominal" state.

Moreover, the hydraulic cylinder 2 is preferably arranged such that the maximum axial length of the (distally) protruding portion of the piston rod 21 is less than or equal to the distance between the distal end of the cylinder housing 23 and an internal seal or packing 17 of the cylinder housing 23. The seal or packing being arranged to seal the internal cavity of the cylinder housing 23 such that hydraulic fluid does not leak out to the environment. This increases the robustness of the tool since the protruding portion of the piston rod 21 (which is prone to external wear and tear in the form of cuts, cracks, dirt, etc.) then is kept from ever coming in contact with and thereby damaging the inner seals or packings 17. Accordingly, the protruding portion of the piston rod 21 is to be understood as the portion of the piston rod 21 that is visible when the hydraulic cylinder 2 is in its most expanded state (nominal state). More specifically, it is the distance between the distal end of the cylinder housing and the closest internal seal or packing 17 of the cylinder housing 23 that is most relevant. Stated differently, the cylinder housing 23 comprises a protecting portion 25 arranged distally from the second receiving portion 4. The additional length of cylinder housing 23 provided by the protecting portion 23 provides not only the required distance between the distal end of the cylinder housing and the internal seals 17, but also stability to the hydraulic cylinder 2 by reducing the risk of bending the piston rod 21 during use.

Figure 5:
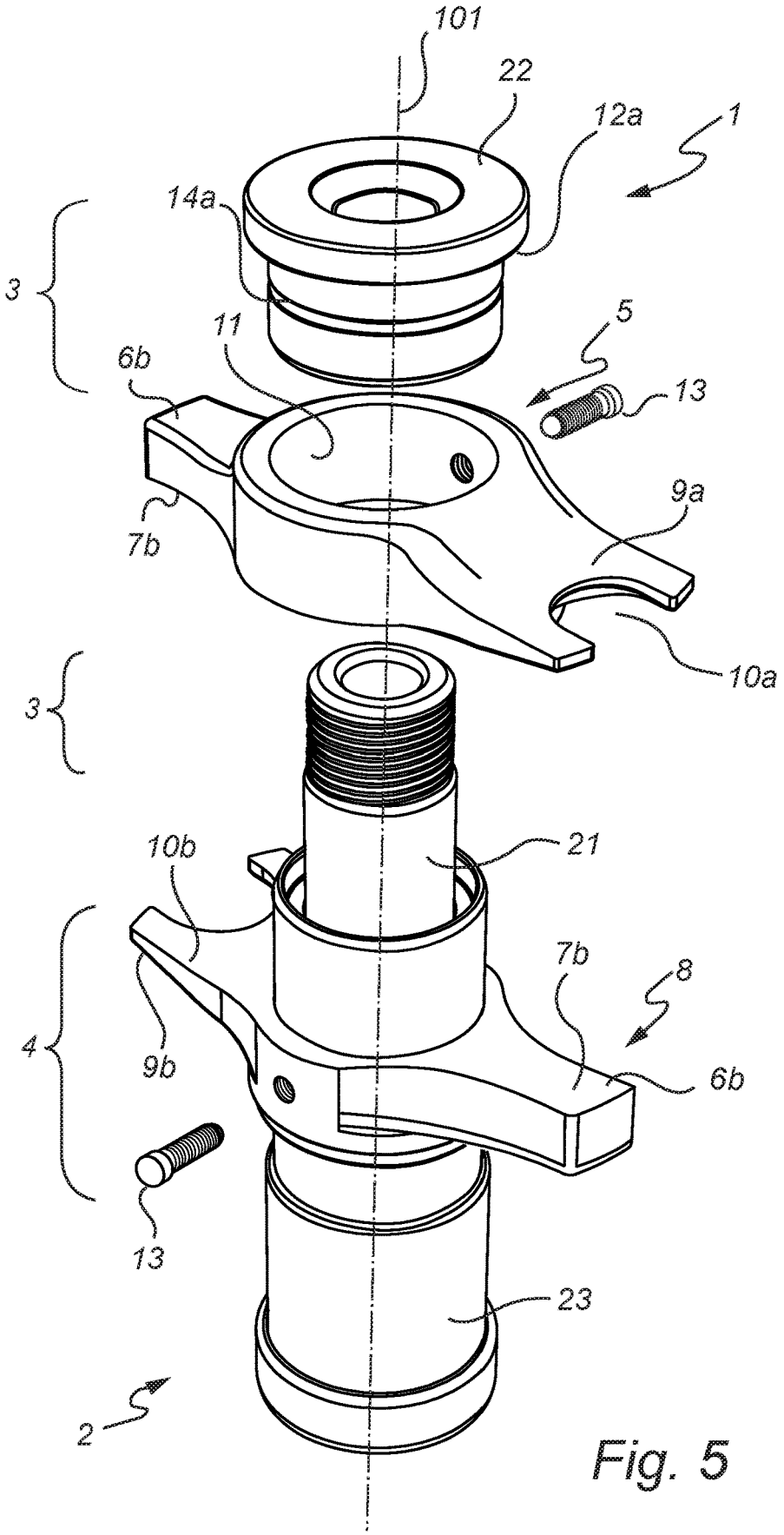
FIG. 5 is a partly exploded perspective view illustration of a dismounting tool in accordance with an embodiment of the present invention.

Further, FIG. 5 is a partly exploded perspective view of a dismounting tool in accordance with another embodiment of the present invention. Here, each tool member 5, 8 is provided with both an anvil portion 6*a*, 6*b* and a bifurcated portion 9*a*. 9*b*. Accordingly, in order to be able to arrange the cylinder housing 23 of the hydraulic cylinder 2 on either side a ball joint connection, one does not need to switch the position of the two tool members 5, 8, but merely twist both of the tool members 180° relative to the actuation axis 101 (or rotate the whole tool 180° about the actuation axis 101 if applicable). The trade-off in comparison to the embodiments discussed in reference to the previous figures being in that there are less possible configurations/settings available. Thus, the tool members 5, 8 need not be interchangeably attachable to the actuator in order to provide versatility in terms of the placement of the cylinder housing 23 of the hydraulic cylinder relative to a ball joint connection during use.

Figure 6:
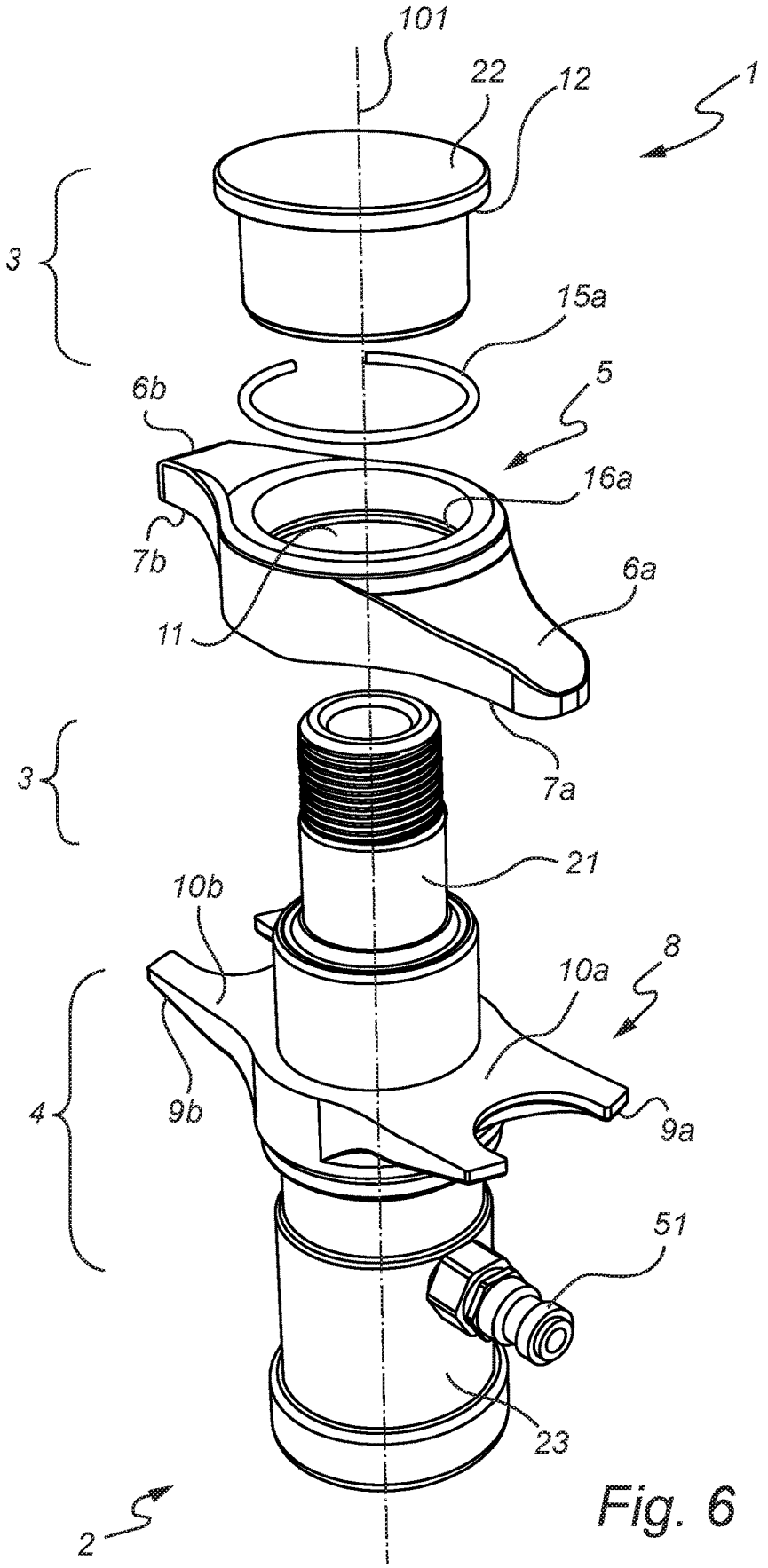
FIG. 6 is a partly exploded perspective view illustration of a dismounting tool in accordance with another embodiment of the present invention.
Figure 7:
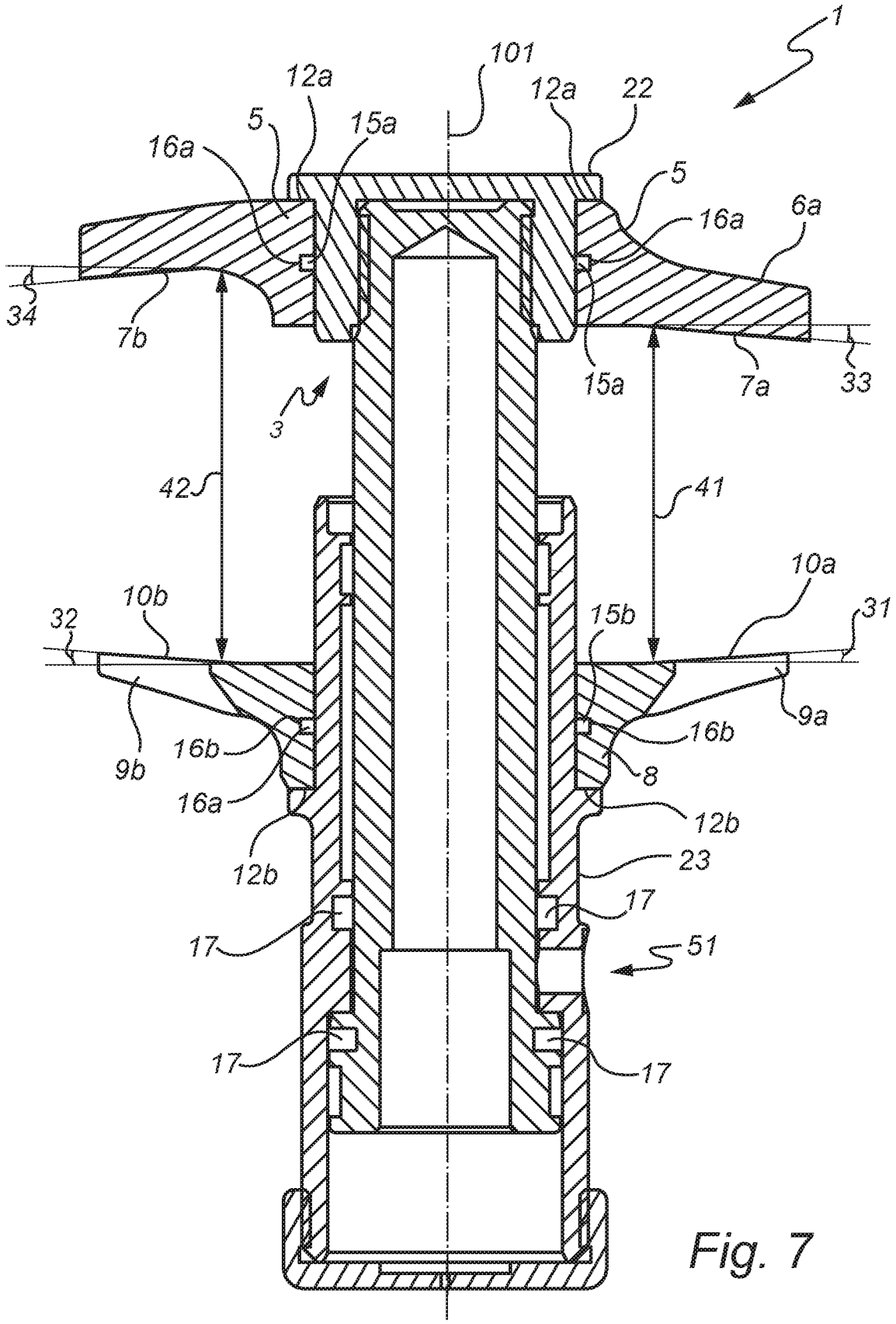
FIG. 7 is a cross-sectional view of the dismounting tool illustrated in FIG. 6.

FIG. 6 is a partly exploded perspective view of a dismounting tool in accordance with another embodiment of the present invention. Here, each of the tool members 5, 8 comprises an alternative fastening means, in the form of a clamping ring 15*a* arranged in a matching groove 16*a* provided at an interior surface of the cylindrical portion which defines the through hole 11 of each tool member. This is further elucidated in FIG. 7 which shows a cross-sectional view of the dismounting tool in FIG. 6, the cross-section being taken along the central axis (actuation axis) of the hydraulic cylinder 2. In FIG. 7, the clamping ring 15*b* of the second tool member 8 is shown.

Figure 8:
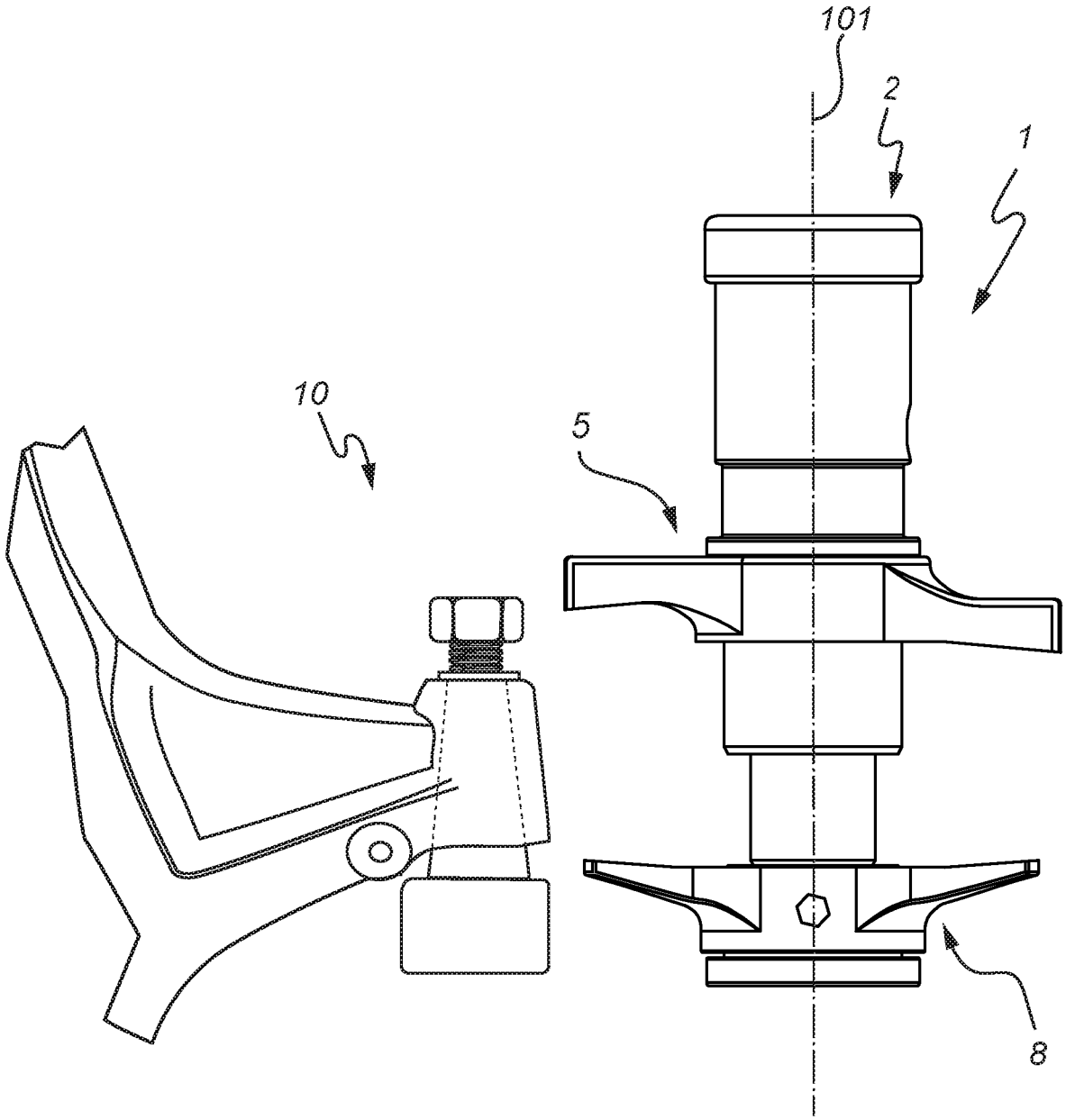
FIG. 8 is a side view illustration of a dismounting tool in accordance with an embodiment of the invention next to a ball joint connection.
Figure 9:
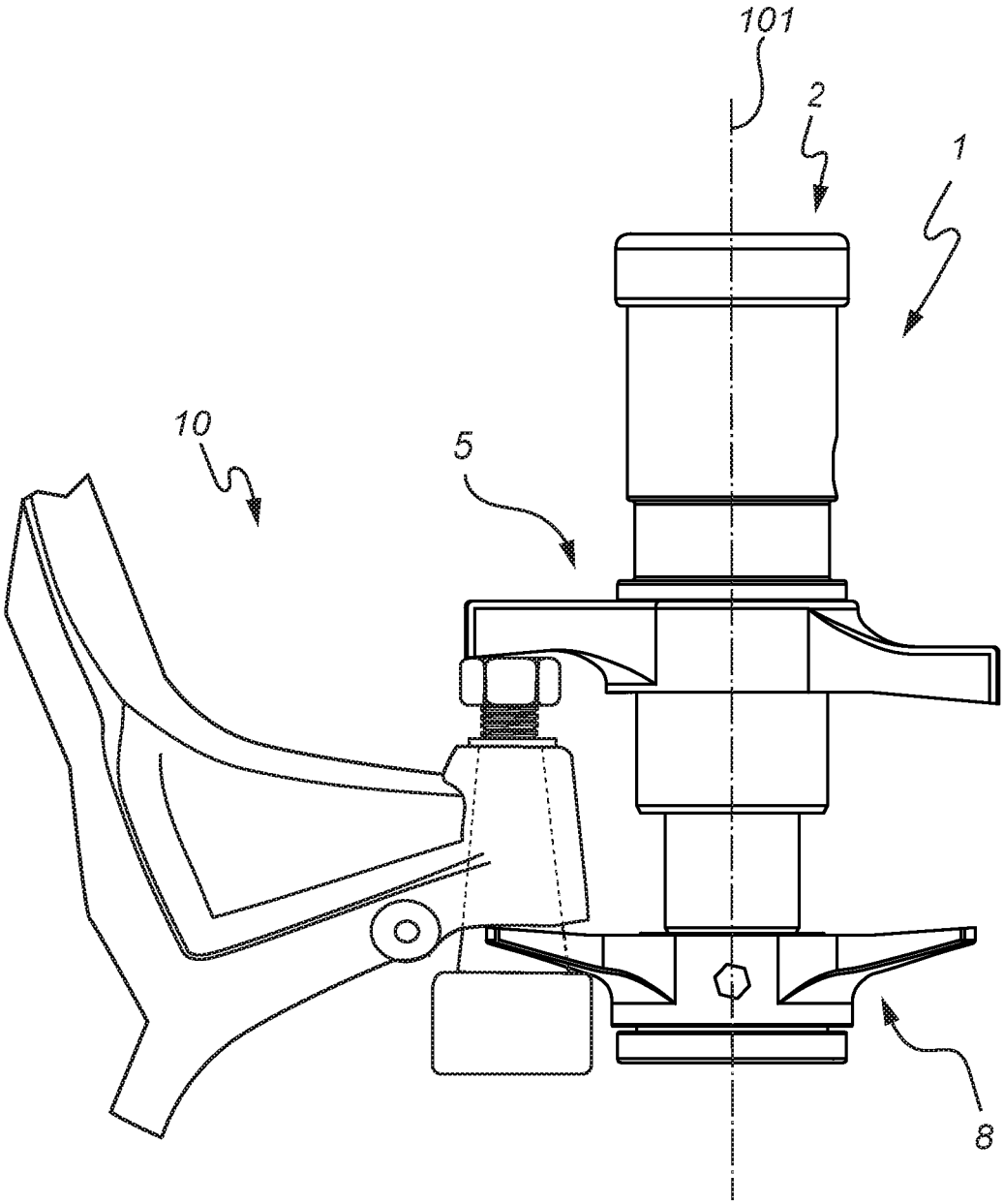
FIG. 9 is a side view illustration of a dismounting tool from FIG. 8 arranged to disengage the ball joint connection.
Figure 10:
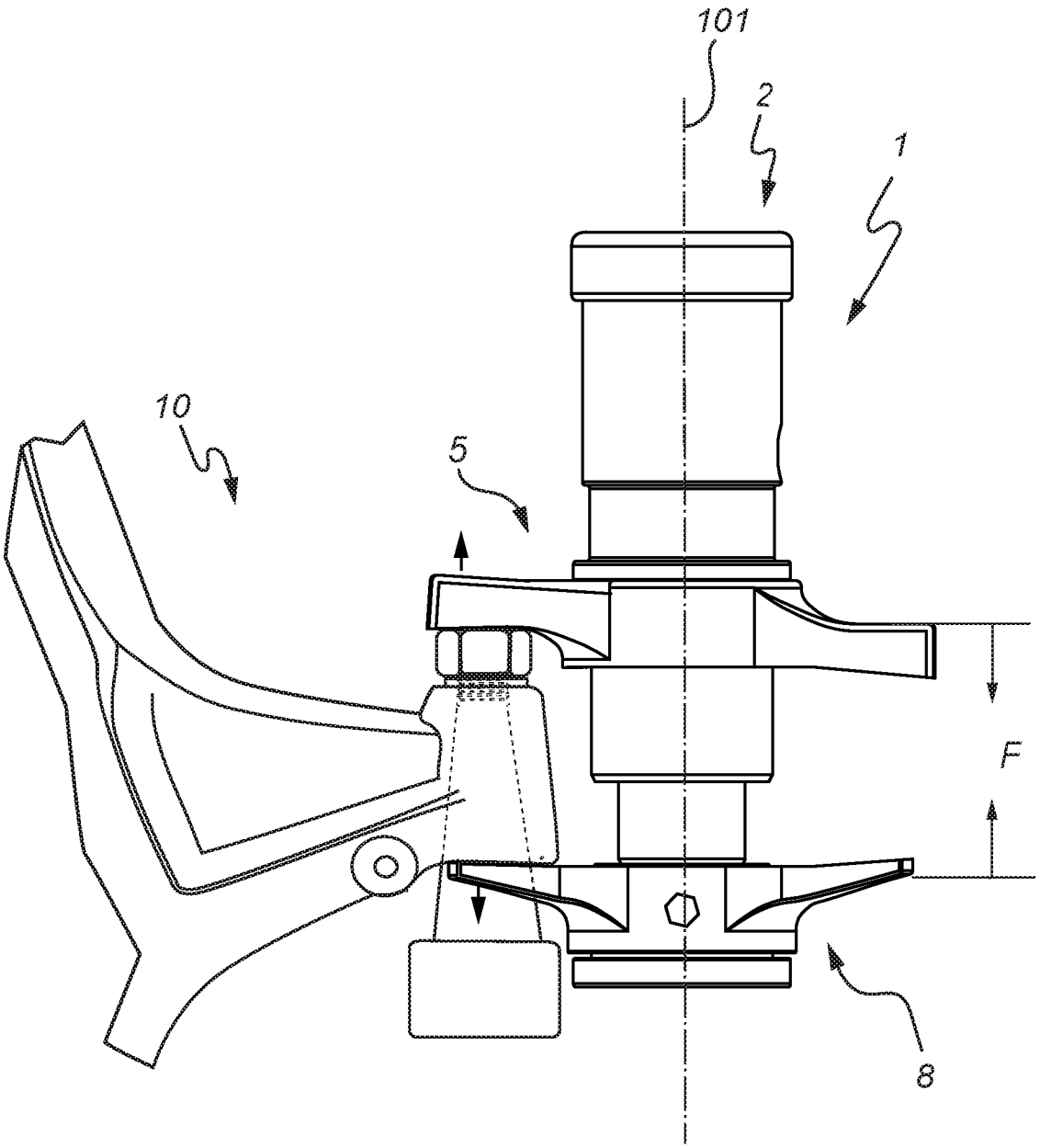
FIG. 10 is a side view illustration of a dismounting tool from FIGS. 8 and 9 after actuation when the ball joint connection has been disengaged.

FIGS. 8-10 schematically illustrate side view perspectives of a dismounting tool 1 being used for disengaging a ball joint connection 10 in a vehicle according to an embodiment of the invention. In FIG. 8 a dismounting tool 1 is provided and aligned with a ball joint connection 10 of a vehicle (a portion of a vehicle axis being indicated in the drawing). As previously discussed, it may be desirable to arrange the cylinder housing 23 of the hydraulic cylinder 2 on the other side of the ball joint connection 10 (protruding downwards instead of upwards as in the figure). Accordingly, by switching the positions of the two tool members 5, 8 the dismounting tool may be used with the cylinder housing 23 pointing downwards instead.

Further, in FIG. 9 the dismounting tool 1 has been brought in contact with the ball joint connection 10 such that a bifurcated portion of the second tool member 8 is arranged around the conical/tapered portion of ball joint component in order to abut against the steering knuckle in order to act as a counter hold when the anvil portion of the first tool member 5 presses the ball joint out of the socket. Next as illustrated in FIG. 10, upon actuation of the actuator 2, the two tool members 5, 8 are moved towards each other (as indicated by arrows F) along the actuation axis 101, whereby the tapered portion of the ball joint component is pressed out of the steering knuckle socket. Moreover, due to the relatively large pressing forces required to disengage the ball joint connection 10 the anvil portion and bifurcated portion of each respective tool member 5, 8 is bent outwardly away from the other, as indicated by the arrows in the figure. Thus, as previously discussed, by having each engaging surface and each supporting surface slanted inwardly towards each other, as indicated by the angles 31-34 in FIGS. 3, 4 and 7, there is an increased probability that the engaging surface and the supporting surface, in use, will be parallel with the contact surfaces (of the ball joint connection) they are brought in engagement with, therefore reducing the risk of the dismounting tool sliding away or losing grip.

The invention has mainly been described above with reference to a few embodiments. However, as is readily appreciated by a person skilled in the art, other embodiments than the ones disclosed above are equally possible within the scope of the invention, as defined by the appended claims. For example, in the illustrated embodiments the actuator has been a hydraulic cylinder, however, the skilled person readily realizes that other actuators such as electric or pneumatic actuators are feasible. In the claims, any reference signs placed between parentheses shall not be construed as limiting to the claim. The word "comprising" does not exclude the presence of other elements or steps than those listed in the claim. The word "a" or "an" preceding an element does not exclude the presence of a plurality of such elements.

The invention claimed is:

1. A dismounting tool for disengaging ball joint connections on suspension and steering assemblies, said dismounting tool comprising:

an actuator comprising a first receiving portion and a second receiving portion, said actuator being operable to force said first and second receiving portions towards each other along an actuation axis of the actuator;

a first tool member comprising an anvil portion with an engaging surface;

a second tool member comprising a bifurcated portion with a supporting surface;

wherein each of said first tool member and said second tool member comprises a through hole, and wherein said first tool member and said second tool member are detachably mounted to said first receiving portion and said second receiving portion such that said through holes are arranged coaxially about said actuation axis, and such that said engaging surface faces said supporting surface; and wherein, upon actuation, said actuator is configured to move said first and second tool members towards each other along said actuation axis.

2. The dismounting tool according to claim 1, wherein each of said first receiving portion and said second receiving portion is provided with a shoulder section for preventing said first and second tool members from moving away from each other when the first and second tool members are attached to said actuator.

3. The dismounting tool according to claim 2, wherein each of said first and second tool members further comprises a fastening element for securing said first and second tool members to said first receiving portion and said second receiving portion.

4. The dismounting tool according to claim 1, wherein said first tool member and said second tool member are interchangeably and detachably mounted to said first receiving portion and said second receiving portion.

5. The dismounting tool according to claim 1, wherein said anvil portion is a first anvil portion and said engaging surface is a first engaging surface, and wherein said first tool member comprises a second anvil portion having a second engaging surface, the second anvil portion being arranged on an opposite side of the through hole of the first tool member relative to the first anvil portion.

6. The dismounting tool according to claim 5, wherein said first tool member is rotatable about said actuation axis such that it is attachable to either one of said first receiving portion and said second receiving portion in two operating positions.

7. The dismounting tool according to claim 5, wherein said first engaging surface and said second engaging surface are provided at different heights relative to each other along said central axis.

8. The dismounting tool according to claim 1, wherein said bifurcated portion is a first bifurcated portion and said supporting surface is a first supporting surface, and wherein said second tool member further comprises a second bifurcated portion having a second supporting surface, the second bifurcated portion being of a different dimension than said first bifurcated portion and arranged on an opposite side of the through hole of the second tool member relative to the first bifurcated portion.

9. The dismounting tool according to claim 8, wherein said second tool member is rotatable about said actuation axis such that it is attachable to either one of said first receiving portion and said second receiving portion in two operating positions.

10. The dismounting tool according to claim 1, wherein each of the first and second tool members comprises an anvil portion and a bifurcated portion, and wherein each of the first and second tool members is rotatable about said actuation axis such that it is attachable to a respective one of said first receiving portion and said second receiving portion in two operating positions.

11. The dismounting tool according to claim 1, wherein each engaging surface and each supporting surface is slanted inwardly towards each other when the first and second tool members are attached to said actuator.

12. The dismounting tool according to claim 1, wherein said actuator is a hydraulic cylinder and said actuation axis is a central axis of said hydraulic cylinder.

13. The dismounting tool according to claim 12, wherein said hydraulic cylinder comprises:

a piston part comprising said first receiving portion, and a cylinder housing comprising said second receiving portion and an inlet for receiving hydraulic fluid.

14. The dismounting tool according to claim 12, wherein said piston part extends distally from said cylinder housing, and wherein said first receiving portion is provided at a distal end portion of said piston part.

15. The dismounting tool according to claim 12, wherein said piston part further comprises a removable cylindrical adapter defining said first receiving portion;

wherein an outer diameter of said cylindrical adapter part is substantially the same as the diameter of the second receiving portion for interchangeably receiving either one of said first and second tool.

* * * * *